US005637930A

United States Patent [19]

Rowen et al.

[11] Patent Number: 5,637,930

[45] Date of Patent: Jun. 10, 1997

[54] WALL-MOUNTABLE SWITCH & DIMMER

[75] Inventors: Michael J. Rowen, Center Valley; Joel S. Spira, Coopersburg; Michael J. D'Aleo, Erwinna; Darryl W. Tucker, Royersford; Russell J. Jacobs, Center Valley; James R. Graybill, Allentown, all of Pa.

[73] Assignee: Lutron Electronics Co., Inc., Coopersburg, Pa.

[21] Appl. No.: 386,850

[22] Filed: Feb. 10, 1995

Related U.S. Application Data

[63] Continuation of Ser. No. 871,876, Apr. 21, 1992, abandoned, which is a continuation of Ser. No. 225,457, Jul. 28, 1988, abandoned.

[51] Int. Cl.[6] ..... H01H 47/00

[52] U.S. Cl. ..... 307/112; 307/125

[58] Field of Search ..... 307/100–125; 323/903

[56] References Cited

U.S. PATENT DOCUMENTS

| | | | |
|---|---|---|---|
| 3,225,265 | 12/1965 | Krause et al. | 317/138 |
| 3,746,923 | 7/1973 | Spira et al. | 315/291 |
| 3,971,028 | 7/1976 | Funk | 343/225 |
| 4,563,592 | 1/1986 | Yuhasz et al. | 307/115 |
| 4,567,375 | 1/1986 | Jimerson et al. | 307/98 |
| 4,764,717 | 8/1988 | Tucker et al. | 323/364 |
| 5,017,837 | 5/1991 | Hanna et al. | 315/136 |
| 5,146,153 | 9/1992 | Luchaco et al. | 323/324 |

OTHER PUBLICATIONS

Home Automation Catalog, Jan. 1984, page 7.
Lutron Electronics Co. – Nets Brochure P/N 362–199.
Lutron Electronics Co. – D–600P Brochure P/N 362–009.
Lutron Electronics Co. – Skylark Brochure P/N 362–168.
Lutron Electronics Co. – Nova® Brochure P/N 360–110.
Extract from Matsushita Electric Works, Ltd. Brochure '89/4 (4th Qtr 1989).

*Primary Examiner*—Aditya Krishnan
*Attorney, Agent, or Firm*—Seidel Coonda Lavorgna & Monaco, PC

[57] ABSTRACT

A wall-mountable system for controlling electrical power to a load includes a switch and a dimmer, with the switch actuator being substantially larger than the dimmer actuator. Preferably, the switch is a short-throw, light-force switch and the dimmer is a linear slide dimmer. Another embodiment of the invention provides a wallbox-mountable, pushbutton-actuated electrical control device in which the pushbutton is resiliently supported on the device support.

221 Claims, 7 Drawing Sheets

WALL-MOUNTABLE SWITCH & DIMMER

BACKGROUND OF THE INVENTION

1. Field of the Invention

This invention is a continuation of co-pending application Ser. No. 07/871,876, filed Apr. 21, 1992 now abandoned, which is a continuation of application Serial No. 07/225,457, filed Jul. 28, 1988 now abandoned, which relates to a switch and dimmer for controlling power to an electrical load.

2. Description of the Related Art

Wallbox mountable dimmers, switches, and combination dimmers and switches have been known for many years. A slide dimmer was disclosed in U.S. Pat. No. 3,746,923, issued Jul. 17, 1973, to Spira et al., and a dimmer of the type disclosed—Nova® linear slide dimmer—is sold by Lutron Electronics Co. Toggle switches are the most common type of wallbox-mounted switch for lighting control, but other types are known, as well. A wallbox-mountable touch switch was disclosed in U.S. Pat. No. 4,563,592, issued Jan. 7, 1986 to S.J. Yuhasz et al., and a switch of the type disclosed—Nova® electronic touch switch—is sold by Lutron Electronics Co.

Combination dimmer-and-switch devices are of two types. In the first type, the switch function is accomplished by operation of the dimmer control. For example, a rotary dimmer can be pushed to operate as a switch, turned to operate as a dimmer. Alternatively, a linear slide dimmer can be designed to operate a switch at the low end of its travel. (See U.S. Pat. No. 3,746,923, referred to above).

The second type of combination dimmer/switch device includes separate actuators for the dimmer and switch functions. Examples of this device are Lutron's Skylark® Model S600P and Nova® Model N-600ML. Another example of this device is available from Home Automation Ltd., in the U.K., and consists of a linear slide dimmer mounted beside a rocker switch (Slider Dimmer Model SC630W ID). The dimmer and switch actuators are mounted side-by-side, each occupying half of a rectangular opening in a faceplate.

Characteristic of prior art dimmer/switches is that their appearance does not emphasize their switching function. Where a single actuator serves both functions, the switch aspect may not be apparent. Where a separate actuator operates the switch, that actuator has occupied a smaller opening in the faceplate, or, at most, an opening the same size as that which accommodates the dimmer actuator.

SUMMARY OF THE INVENTION

In accordance with the present invention, a wallbox-mountable system for controlling electrical power to a load comprises, in combination, (a) switch means for turning said power on and off, (b) dimmer means for controlling the amount of power provided to said load, and (c) first and second actuator means, said first actuator means adapted for operating said switch means and being substantially larger than said second actuator means, which is adapted for operating said dimmer means.

The device of the present invention is ergonomically simple, with the switch function being primary and dominating the switch-and-dimmer combination. Typically, the switch actuator is at least twice as large as the dimmer actuator, more preferably, at least four times as large.

In another embodiment of the present invention, wallbox-mountable electrical control comprises, in combination, (a) a pushbutton-actuated electrical control device, (b) means for supporting said device, attachable to said wallbox, (c) a faceplate for mounting over said support means, said faceplate having an opening through it, (d) a pushbutton, resiliently supported on said support means and actuatable through said opening in said faceplate, and (e) means for transmitting a force applied to said pushbutton to provide control of said device.

DETAILED DESCRIPTION OF THE INVENTION

The present invention provides a combined switch and dimmer for controlling electrical power to a load, in which the primary element is the switch. As used in this specification and the appended claims, a "dimmer" is understood to be a device that controls the power to be provided to a load, which may be a lighting load; not the more narrow meaning in which the load must be a lighting load.

Figure 1:
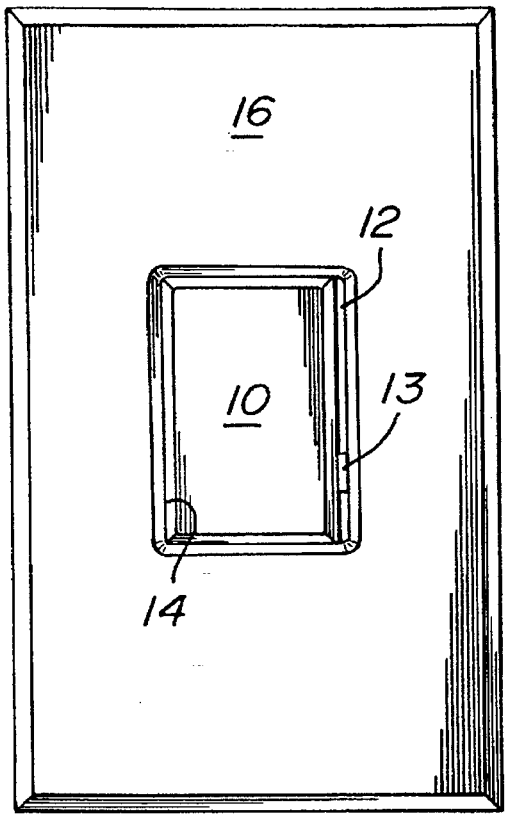
FIG. 1 is a front view of a switch and dimmer of this invention.

One embodiment of the present invention is depicted in FIG. 1, which shows a frontal view of a touch switch 10 and slide dimmer actuator 12 contained within rectangular opening 14 of faceplate 16. Actuator 12 controls a linear potentiometer, whose wiper position determines the power to a load. Of course, actuator 12 could be positioned on either side of the faceplate or in the middle. Alternatively, actuator travel could be horizontal, along the top, bottom, or center of the faceplate. The handle 13 of actuator 12 may be spring-loaded, so that it can retract—e.g., to the side or into the faceplate—when not being used to adjust the power. The term actuator, as used herein, is understood to comprise the entire element that is seen to move (e.g. 12), not just the handle (e.g. 13). Thus, the length of actuator 12 is slightly greater than that of switch 10. As used in this specification and the appended claims, "touch switch" designates a switch that is activated by a soft touch and that involves little or no actuator travel to accomplish its function. A touch switch typically controls power to a load through an intermediate controllably conductive device (i.e., an electronic switch), such as a thyristor, transistor, or relay. The touch switch itself provides switching at voltages well below line voltage. In a preferred embodiment, switch 10 is a biased, alternate-action touch switch. Alternatively, switch 10 may be a mechanical power switch and handle full power from the line.

Figure 2:
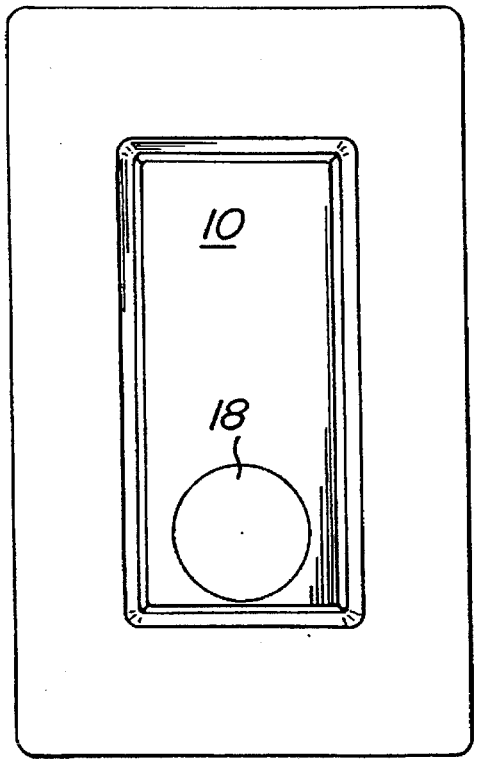
FIG. 2 is a front view of another embodiment of this invention.

FIG. 2 depicts an embodiment of the present invention which includes a touch switch 10 and a rotary dimmer with actuator 18, in place of a slide dimmer. Actuator 18 operates a rotary potentiometer that controls the power to a load. The potentiometer may be of the type whose shaft is spring-loaded and "pops out" for adjustment and may then be pushed in. An example of this type of potentiometer is Model RK097111T, available from ALPS Electronic Co., San Jose, Calif. A thumbwheel is another alternative dimmer actuator.

Figure 3:
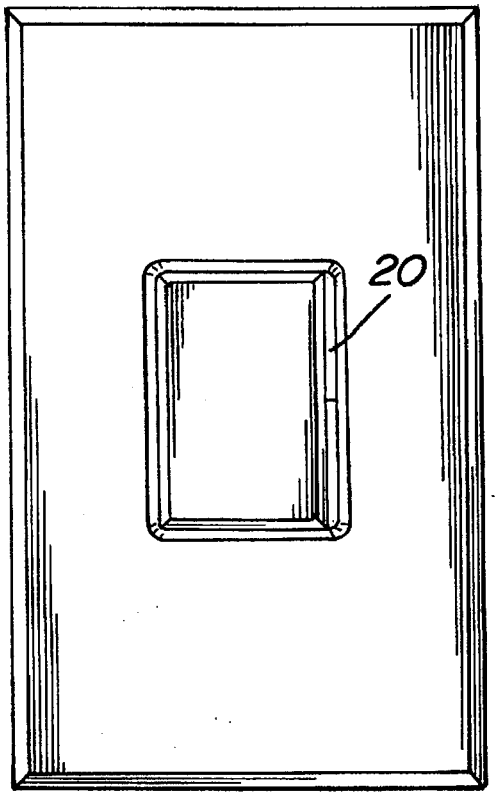
FIG. 3 is an front view of another embodiment of this invention.
Figure 3A:
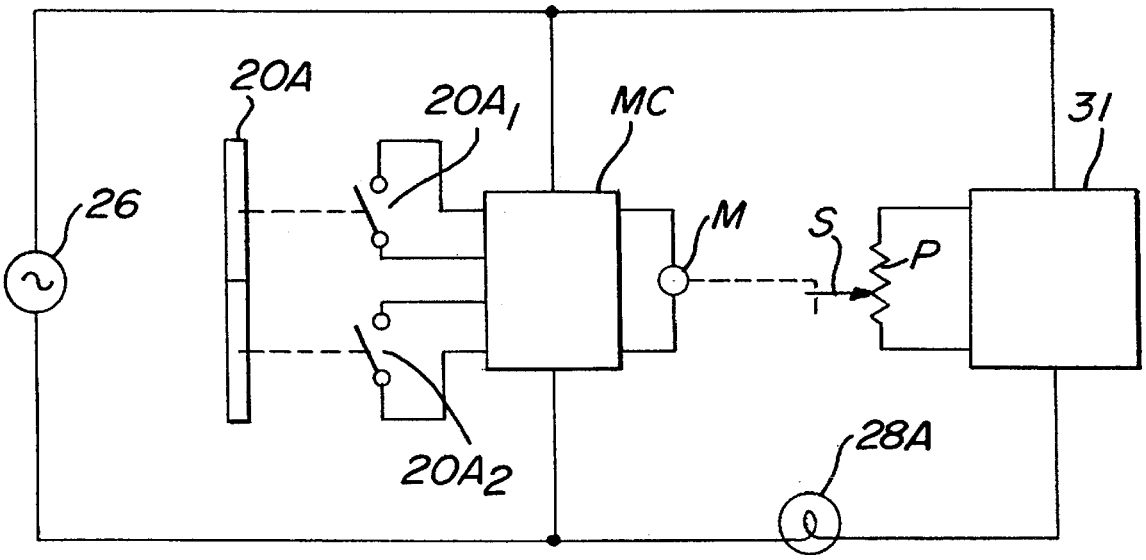
FIG. 3A an illustration of other embodiments of the present invention utilizing a motorized potentiometer control.
Figure 4:
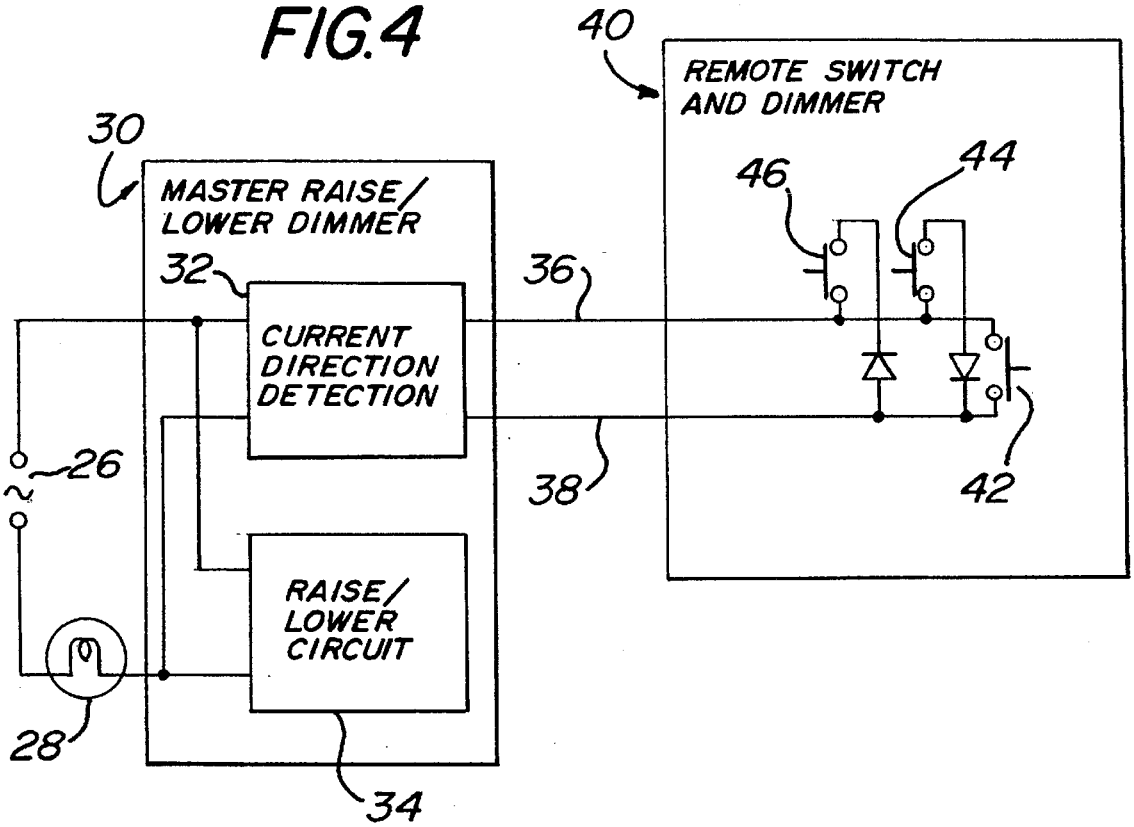
FIG. 4 is a circuit schematic of an embodiment of this invention.

FIG. 3 depicts an embodiment of the present invention in which the dimmer function is provided by a raise/lower rocker 20. Pushing the upper half of the rocker causes the power to a load to increase; pushing the lower half causes the power to decrease. The rocker may be split in half horizontally to form an upper element that is depressed to raise and a lower element to lower. The raise/lower mechanism may drive a motorized potentiometer or operate electronically. Such a mechanism is generally illustrated in FIG. 3A showing, a rocker-type switch 20A having upper and lower contacts $\mathbf{20}A_1$ and $\mathbf{20}A_2$, respectively, interconnected to a control circuit that is connected to a power source 26. The control circuit comprises a motor control (MC) that is coupled to a motor (M) which, in turn, is connected to the shaft (S) of a potentiometer (P). When closed, the upper switch contact $\mathbf{20}A_1$ applies the excitation of the source 26 to the motor control (MC) causing the motor (M) to move in a first or clockwise direction which, in turn, causes the setting of potentiometer (P) to change so as to raise or increase the power supplied through conventional dimmer circuit 31 to a load 28 such as an electric lamp 28A. Conversely, when closed, the lower switch contact $\mathbf{20}A_2$ applies the excitation of the source 26 to the motor control (MC) causing the motor (M) to move in a second or counterclockwise direction which, in turn, causes the setting of potentiometer (P) to change so as to lower or decrease the power supplied through conventional dimmer circuit 21 to the load 28A. Further, the switch and dimmer of FIG. 3 can be remote from a master raise/lower dimmer, with only two wires joining the devices; and FIG. 4 is a schematic of a circuit that accomplishes that. Source 26 provides power to load 28. Master dimmer 30 includes a circuit 32 that detects the direction of current flow and controls a raise/lower circuit 34. Wires 36 and 38 carry ac power to the remote switch-and-dimmer unit 40, which includes switches 42, 44, and 46, which provide "on/off", "raise" and "lower" functions, respectively. When switch 42, which may be a momentary contact switch, provides closure, then circuit 32 detects current flowing in both directions. When switch 44 or 46 is activated, only one polarity of current (either positive or negative, depending on diode polarity) is detected by circuit 32. In this way, four different states of the remote unit can be sensed—no current, positive current, negative current, and both polarities, corresponding to no signal, raise power, lower power, and alternate on/off switching, respectively.

Figure 5:
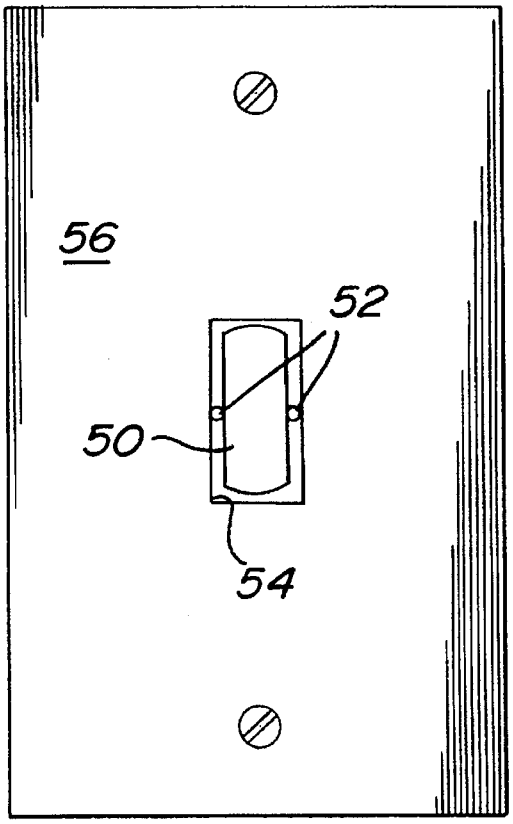
FIG. 5 is a front view of another switch and dimmer of this invention.
Figure 5A:
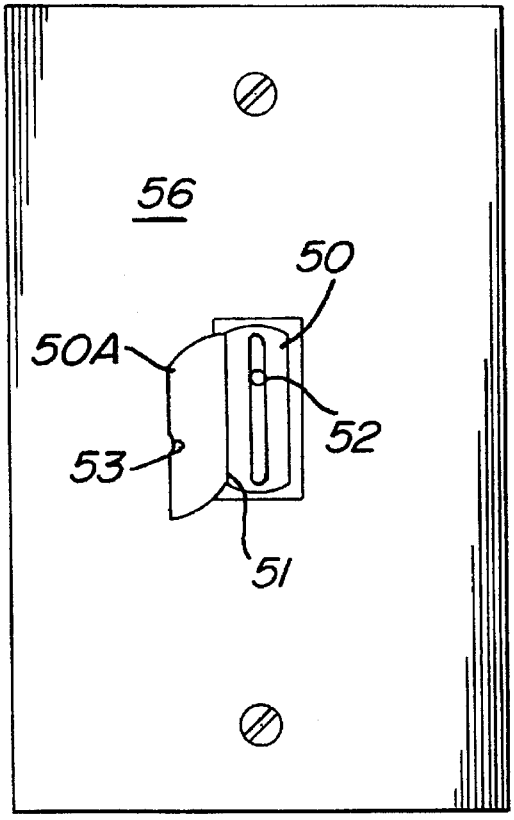
FIG. 5A is an illustration of another embodiment having a hinged door member for covering the dimmer actuator.

The present invention is also adapted for use with a standard "toggle" faceplate, in which the opening is a rectangle that is about 25 mm high and 12 mm wide. FIG. 5 depicts an embodiment in which both pushbutton 50 and slide actuator 52 are accommodated within standard toggle opening 54 in faceplate 56. Preferably, the switch actuated by pushbutton 50 is a biased, alternate-action mechanical pushbutton switch. It may include a "dead travel" of at least 1 mm from its rest position. Depressing the pushbutton over the dead travel range does not affect the switch; thus, the switch is not likely to be actuated accidentally by a person brushing against it. Note that slide actuator 52 moves in and out with pushbutton 50. The slide actuator may be within, rather than outside the pushbutton area and, optionally, may be hidden from view behind a hinged or sliding door on the front of the pushbutton. Such a hinged door arrangement is shown in FIG. 5A where slide actuator 52 is within pushbutton 50 and is removably covered by hinged door 50A. Hinged door 50A is connected to pushbutton 50 along hinge line 51 and has a notch 53 into which a fingernail can be inserted to allow the operator to easily open the hinged door. The embodiment of FIG. 1 may be adapted for use with a toggle faceplate, simply by scaling the faceplate opening to 25 mm high×12 mm wide.

Figure 2A:
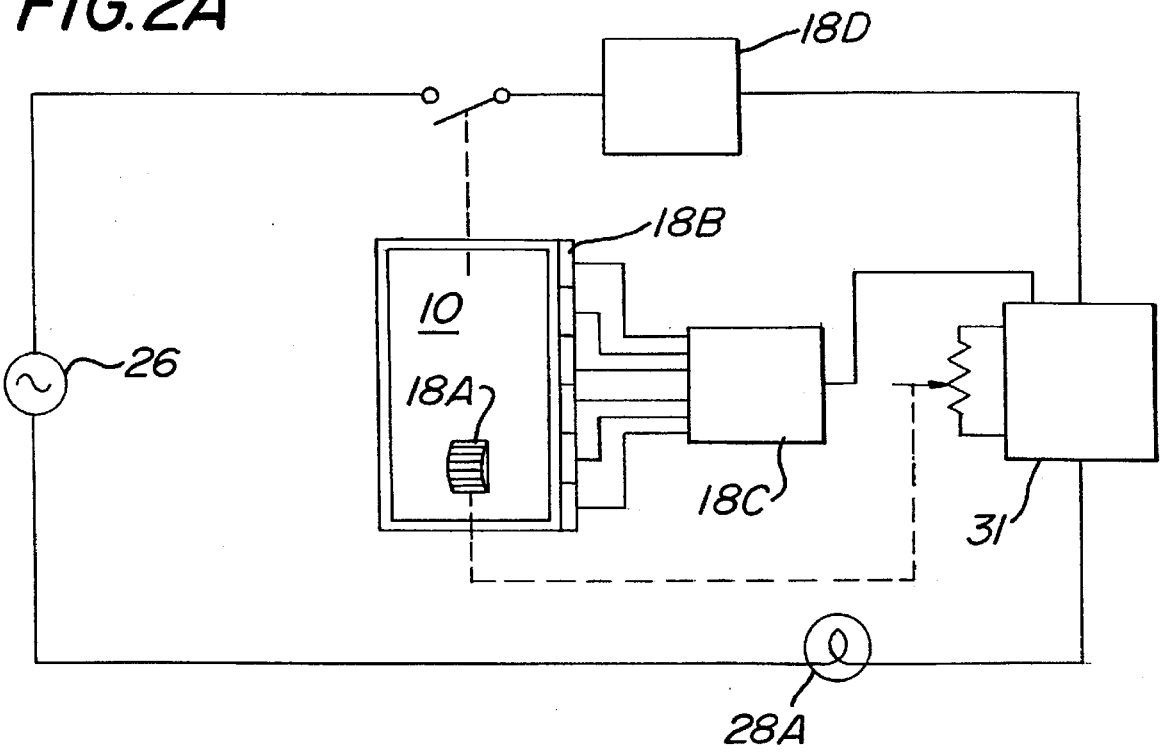
FIG. 2A is a functional illustration of other embodiments of the present invention utilizing a thumbwheel adjustment.

The switch-and-dimmer device of this invention, is preferably used to control a lighting load. It is often desirable to have, at the control device, an indication of the status of the lighting, particularly if the device is remote from the space illuminated by the load. Such an indication can take a variety of forms and can be mounted on the faceplate or on one of the actuators. For example, a light (such as an LED) on the device can be dim if the lighting load is off and bright if the load is on. Such a "status" light is disclosed in U.S. Appl. Ser. No. 131,776, incorporated herein by reference. Alternatively, an indicator may be quantitative or semi-quantitative, such as a lighting intensity indicator on the device. The indicator could comprise a vertical array of LEDs that light in succession as power to the load is increased and that go out as power is reduced. Such an arrangement is generally illustrated in FIG. 2A where the thumbwheel 18A is used to adjust the power applied to the lighting load 28A from source 26. The relative intensity of the adjusted power is indicated by a vertical array of LEDs 18B that is sequentially responsive to a display driver 18C that is connected to an output from dimmer circuit 31 whose output signal is indicative of the power supplied to the lighting load 28A.

The response of load power to the operation of the switch and dimmer of the invention may be immediate, but it need not be. Various time-delay circuits, well known in the art, can be used with this invention to delay the onset of a changed load power status and/or to cause the change to occur over a period of time (i.e., "fade"). The delay and/or fade rate may be fixed or adjustable. The arrangement of such a delay device is generally illustrated in FIG. 2A in which time delay means 18D employing, for example, one or more thermistors whose resistance decrease as a result of self-heating, may be interposed, in a serial manner, between the lighting load 28A and the output side of the switch 10.

Figure 6:
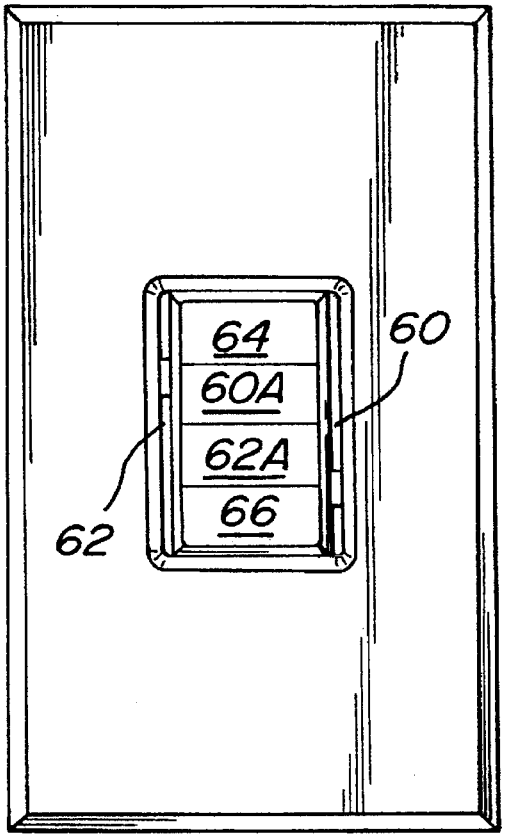
FIG. 6 is a front view of a multi-segment switch and dimmer of this invention.
Figure 9:
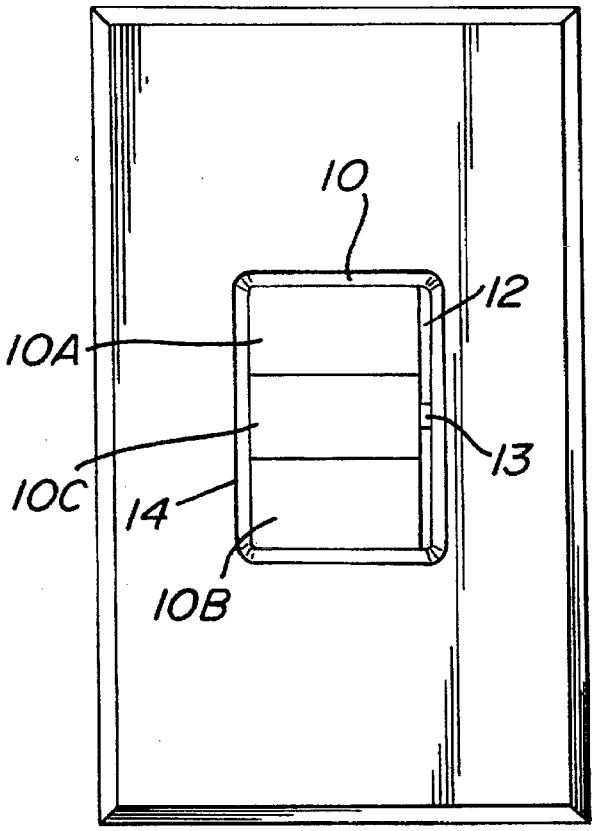
FIG. 9 is a front view of a switch segmented into two or more parts.

A variety of extensions are envisioned within the scope of this invention, beyond the device of the type shown in FIG. 1. As depicted there, alternate action switch 10 alternately turns power to the load off and provides to the load an amount of power that is determined by the position of actuator 12. However, the switch may be segmented into two or more parts as shown in FIG. 9. The switch 10 of FIG. 9 comprises a segmented switch with two or more parts, and has associated with it an actuator having an upper portion 10*a* for turning power to the load on, and lower portion 10*b* for turning power to the load off. Further, the switch 10 has a central portion 10c on the actuator for housing means for detecting a signal, such as radiant energy from an external source for controlling operation of the switch in response to the signal. (See discussion below). A two-part switch could provide "on" and "off ", a three-part switch could provide "full " on, "preset " (i.e., the level determined by the dimmer), and "off. " Likewise, one or more additional dimmers could be incorporated into the device to provide additional "preset " levels selectable by actuating additional switch segments. FIG. 6 depicts a device that includes two dimmers 60 and 62, to provide two "preset" levels, and a four-segment switch to permit the selection of preset 60 by depressing segment 60A, preset 62 by depressing 62A, full on by depressing 64, and off by depressing 66.

The switch-and-dimmer devices discussed above are manually operated. Devices of similar appearance could be remotely operated, controlled by wire or wireless. Infrared, radio, sound or other wireless methods, well known in the art, are suitable, provided that the devices have the appropriate detectors. Wireless operation of dimmer and switch devices is described in co-pending U.S. Appl. Ser. No. 079,847, which is incorporated herein by reference. If a load is controlled from more than one location, then a dimmer-switch device can also include a "take command" button to put that particular device in control of power to the load.

Figure 7:
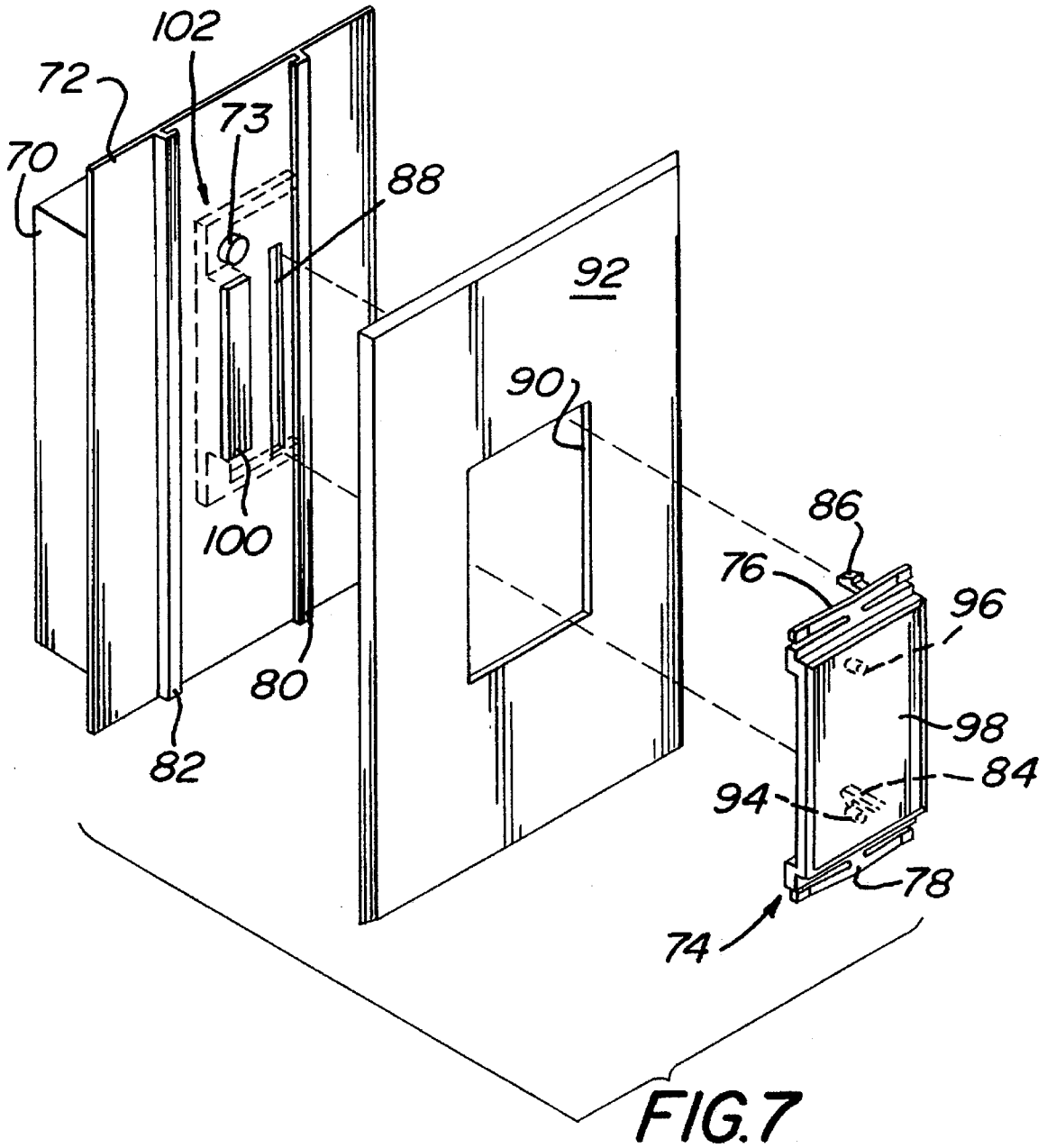
FIG. 7 is an exploded isometric view of a pushbutton device of this invention.

FIG. 7 is an exploded isometric drawing of a pushbutton-actuated device of the present invention. Electrical control device 70 is supported by element 72 for mounting in a wallbox (not shown). Preferably, control device 70 is an alternate-action switch, more preferably a short-throw device. Alternatively, 70 is a dimmer that controls power to a load by increasing power while the switch is depressed and cycling after reaching maximum power. Pushbutton 74 has resilient legs 76 and 78 that are captured on support element 72. An indicator lamp 73 may be placed between the support means 72 and the pushbutton 74. The resiliency of legs 76 and 78 desirably provides a built-in bias, somewhat like a dome switch. Resilient legs 76 and 78 can be captured on support 72 in a variety of ways. One or more rails, such as 80 and 82 can constrain the legs right and left. Optional arms 84 and 86 can be snapped into the ends of optional slot 88 to constrain the pushbutton at the top and bottom and obviate the need for constraint rail 80. Pushbutton 74 may be actuated through opening 90 in faceplate 92. Force transmitter means 94 and 96 are mounted on pushbutton 74 on the reverse side from pushbutton face 98. Pushing face 98 causes force transmitters 94 and 96 to push surface 100 of pivoted hinge bar 102, which in turn actuates electrical control device 70.

Figure 8:
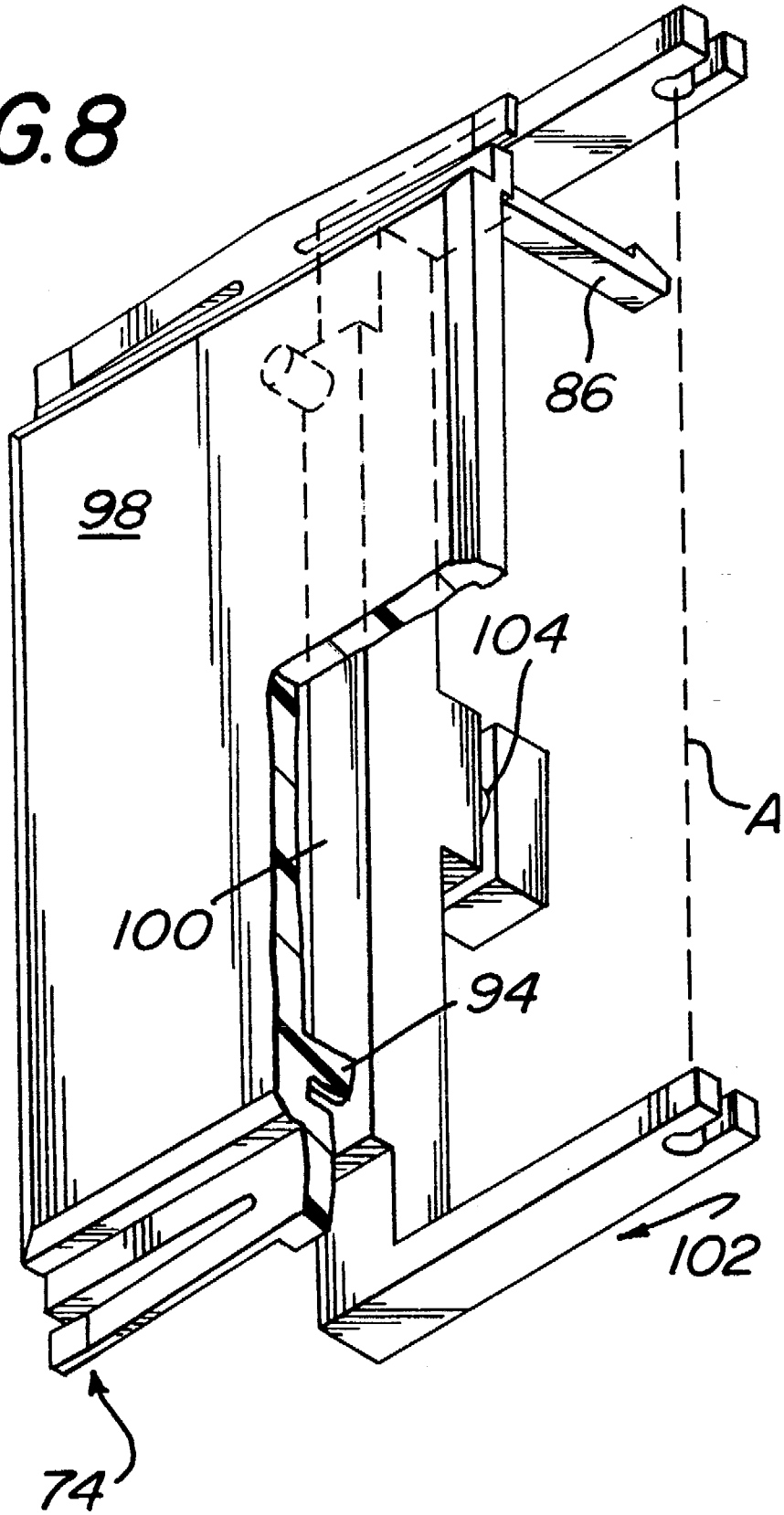
FIG. 8 is a partially cutaway view of some elements of FIG. 7.

FIG. 8 shows an isometric view, in partial cutaway, of pushbutton 74 and pivoted hinge bar 102, which pivots about axis A. FIG. 8, by omitting support means 72 and faceplate 92, clarifies the manner in which a force applied to face 98 is transmitted through transmitters 94 and 96 and surface 100 to depress plunger 104 and actuate control device 70.

If the pushbutton face 98 is generally opaque, then a hidden nightlight could be provided by making face 98 translucent over a small part of its area and backlighting that area with an LED or similar small light. The translucent region can be provided by thinning 98 over a small area or by cutting out an area from 98 and optionally filling the area with a partially transmissive material. If the backlight is spaced away from face 98, then force transmitter 94 or 96 could act as a light pipe.

The pushbutton mechanism of FIGS. 7 and 8 and a slide dimmer can be mounted on a single support plate to provide a device like that shown in FIG. 1.

The present invention having been described in connection with preferred embodiments, many variations and modifications will now become apparent to those skilled in the art. Therefore, the present invention is to be limited not by the specific disclosure, but only by the appended claims.

By "substantially larger " as used in the claims is meant at least twice as large.

We claim:

1. A wall-mountable system for controlling electrical power to a load comprising, in combination:

(a) switch means for turning said power on and off, including first pushbutton or touch actuator means constructed and arranged for operating said switch means; and (b) dimmer means for controlling the amount of power provided to said load, including second actuator means constructed and arranged for operating said dimmer means, said first actuator means constructed and arranged for being operated by a user and having a surface area which is substantially larger than the surface area of said second actuator means which is constructed and arranged for being operated by the user, said first and second actuator means being located immediately adjacent to each other, said first and second actuator means occupying a region which serves as an active control zone for said wall-mountable system, said active control zone having a surface area which is dominated by the surface area of said first actuator means, whereby the switch function is emphasized over the dimmer function to the user.

2. The system of claim 1, further comprising a faceplate for mounting over said switch and dimmer means, said faceplate having an opening through which said first and second actuators extend.

3. The system of claim 1, in which said switch means is mechanical.

4. The system of claim 1, in which said switch means comprises an electronic touch switch.

5. The system of claim 1, in which said switch means is an alternate-action switch.

6. The system of claim 1, in which said switch means is a biased pushbutton switch.

7. The system of claim 1, in which depressing said pushbutton about 1 mm does not activate said switch.

8. The system of claim 1, in which said dimmer means is a raise-lower dimmer and comprises a rocker device which is split into two separate portions, and whereby the depression of one portion causes an increase of said power provided to said load and, conversely, the depression of the other portion causes a decrease of said power provided to said load.

9. The system of claim 8, in which said dimmer means comprises a motorized potentiometer control.

10. The system of claim 8, in which said dimmer means comprises an electronic control.

11. The system of claim 10, in which said electronic control includes a remote control joined to said dimmer means by not more than two wires.

12. The system of claim 1, in which said second actuator means is a linear slide.

13. A wall-mountable system for controlling electrical power to a load comprising, in combination:

(a) switch means for turning said power on and off, including first pushbutton or touch actuator means constructed and arranged for operating said switch means; and (b) dimmer means for controlling the amount of power provided to said load, including second actuator means constructed and arranged for operating said dimmer means, said first actuator means being substantially larger than said second actuator means, said second actuator means being a linear slide and in which said first actuator means is a pushbutton and is located immediately adjacent to said linear slide, whereby the switch function is emphasized over the dimmer function to the user.

14. The system of claim 13, further comprising an element on said pushbutton for removably covering said linear slide.

15. The system of claim 1, in which said second actuator means is a thumbwheel.

16. The system of claim 1, in which said second actuator means is a rotary knob.

17. The system of claim 16, in which said rotary knob is retractable.

18. The system of claim 2, in which said opening is rectangular.

19. The system of claim 18, in which length and width dimensions of said opening are about 25 mm and about 12 mm, respectively.

20. The system of claim 1, further comprising time-delay circuit means for controllably delaying switching of said power on and off.

21. The system of claim 1, further comprising lamp means for indicating whether power to said load is on.

22. The system of claim 21, in which said lamp means is a light-emitting diode.

23. The system of claim 21, in which said lamp means emits a light intensity that is greater when said power is on than when said power is off.

24. The system of claim 21, in which said second actuator means is a linear slide and said lamp means moves with said slide.

25. The system of claim 1, further comprising means for indicating the amount of power being provided to said load.

26. The system of claim 25, in which said indicating means comprises a light-emitting diode.

27. The system of claim 1, further comprising means for remotely controlling said switch means and dimmer means.

28. The system of claim 27, in which said means for remotely controlling is wireless.

29. The system of claim 28, in which said means for remotely controlling comprises an infrared signal transmitter.

30. The system of claim 1, further comprising an additional switch, controlled by a corresponding switch actuator.

31. The system of claim 1, further comprising an additional dimmer, controlled by a corresponding dimmer actuator.

32. The control of claim 31, further comprising an indicator lamp between said support means and said pushbutton.

33. The control of claim 32, in which said force transmitting means is a light pipe and extends between said indicator lamp and said pushbutton.

34. A wallbox-mountable electrical control comprising, in combination, (a) a pushbutton-actuated electrical control device, (b) support means for supporting said device, attachable to said wallbox, (c) a faceplate for mounting over said support means, said faceplate having an opening, (d) a pushbutton, resiliently supported on said support means and actuatable through said opening in said faceplate, (e) means for transmitting a force applied to said pushbutton to provide control of said device, and (f) an indicator lamp located between said support means and said pushbutton.

35. The control of claim 34, in which said force transmitting means is a light pipe and extends between said indicator lamp and said pushbutton.

36. A wall-mountable system for controlling electrical power to a load comprising, in combination:

(a) switch means for turning said power on and off, said switch means including a first actuator means constructed and arranged for operating said switch means; and (b) dimmer means for controlling the amount of power provided to said load, said dimmer means including a second actuator means constructed and arranged for operating said dimmer means, said first actuator means constructed and arranged for being operated by a user and having a surface area which is substantially larger than the surface area of said second actuator means which is constructed and arranged for being operated by the user, said second actuator means being located at the perimeter of said first actuator, whereby the switch function is emphasized over the dimmer function to the user.

37. The system of claim 36, further comprising a faceplate for mounting over said switch means and dimmer means, said faceplate having an opening through which said first and second actuators extend.

38. The system of claim 36, in which said switch means is mechanical.

39. The system of claim 36, in which said switch means comprises an electronic touch switch.

40. The system of claim 36, in which said switch means is an alternate-action switch.

41. The system of claim 36, in which said switch means is a biased pushbutton switch.

42. The system of claim 41, in which said first actuator means is a pushbutton and depressing said pushbutton about 1 mm does not activate said switch.

43. The system of claim 36, in which said dimmer means is a raise-lower dimmer and said second actuator means comprises a rocker device which is split into two portions, and whereby the depression of one portion causes an increase of said power provided to said load and, conversely, the depression of the other portion causes a decrease of said power provided to said load.

44. The system of claim 43, in which said dimmer means comprises a motorized potentiometer control.

45. The system of claim 43, in which said dimmer means comprises an electronic control.

46. The system of claim 45, in which said electronic control includes a remote control joined to said dimmer means by not more than two wires.

47. The system of claim 36, in which said second actuator means is a linear slide.

48. The system of claim 36, in which said second actuator means is a thumbwheel.

49. The system of claim 36, in which said second actuator means is a rotary knob.

50. The system of claim 49, in which said rotary knob is retractable.

51. The system of claim 33, in which said opening is rectangular.

52. The system of claim 51, in which length and width dimensions of said opening are about 25 mm and about 12 mm, respectively.

53. The system of claim 36, further comprising time-delay circuit means for controllably delaying switching of said power on and off.

54. The system of claim 36, further comprising lamp means for indicating whether power to said load is on.

55. The system of claim 54, in which said lamp means is a light-emitting diode.

56. The system of claim 54, in which said lamp means emits a light intensity that is greater when said power is on than when said power is off.

57. The system of claim 54, in which said second actuator means is a linear slide and said lamp means moves with said slide.

58. The system of claim 36, further comprising means for indicating the amount of power being provided to said load.

59. The system of claim 58, in which said indicating means comprises a light-emitting diode.

60. The system of claim 36, further comprising means for remotely controlling said switch means and dimmer means.

61. The system of claim 60, in which said means for remotely controlling is wireless.

62. The system of claim 61, in which said means for remotely controlling comprises an infrared signal transmitter.

63. The system of claim 36, further comprising an additional switch means, controlled by a corresponding switch actuator.

64. The system of claim 36, further comprising an additional dimmer means, controlled by a corresponding dimmer actuator.

65. A wall-mountable system for controlling electrical power to a load, said system having a faceplate with a centerline and comprising, in combination:

(a) switch means for turning said power on and off, said switch means including a first actuator means constructed and arranged for operating said switch means; and (b) dimmer means for controlling the amount of power provided to said load, said dimmer means including a second actuator means constructed and arranged for operating said dimmer means, said first actuator means being centrally positioned on said faceplate and said second actuator means being located at a distance from said centerline, wherein said first actuator means has a surface area at least two times as large as the surface area of said second actuator means, whereby the switch function is emphasized over the dimmer function to the user.

66. The system of claim 65, said faceplate being constructed and arranged for mounting over said switch means and dimmer means, said faceplate having an opening through which said first and second actuator means extend.

67. The system of claim 65, in which said switch means is mechanical.

68. The system of claim 65, in which said switch means comprises an electronic touch switch.

69. The system of claim 65, in which said switch means is an alternate-action switch.

70. The system of claim 65, in which said switch means is a biased pushbutton switch.

71. The system of claim 70, in which said first actuator means is a pushbutton and depressing said pushbutton about 1 mm does not activate said switch.

72. The system of claim 65, in which said dimmer means is a raise-lower dimmer and said second actuator means comprises a rocker device which is split into two portions, and whereby the depression of one portion causes an increase of said power provided to said load and, conversely, the depression of the other portion causes a decrease of said power provided to said load.

73. The system of claim 72, in which said dimmer means comprises a motorized potentiometer control.

74. The system of claim 72, in which said dimmer means comprises an electronic control.

75. The system of claim 74, in which said electronic control includes a remote control joined to said dimmer means by not more than two wires.

76. The system of claim 65, in which said second actuator means is a linear slide.

77. The system of claim 65, in which said second actuator means is a thumbwheel.

78. The system of claim 65, in which said second actuator means is a rotary knob.

79. The system of claim 78, in which said rotary knob is retractable.

80. The system of claim 66, in which said opening is rectangular.

81. The system of claim 80, in which length and width dimensions of said opening are about 25 mm and about 12 mm, respectively.

82. The system of claim 65, further comprising time-delay circuit means for controllably delaying switching of said power on and off.

83. The system of claim 65, further comprising lamp means for indicating whether power to said load is on.

84. The system of claim 83, in which said lamp means is a light-emitting diode.

85. The system of claim 83, in which said lamp means emits a light intensity that is greater when said power is on than when said power is off.

86. The system of claim 83, in which said second actuator means is a linear slide and said lamp means moves with said slide.

87. The system of claim 65, further comprising means for indicating the amount of power being provided to said load.

88. The system of claim 87, in which said indicating means comprises a light-emitting diode.

89. The system of claim 65, further comprising means for remotely controlling said switch means and dimmer means.

90. The system of claim 89, in which said means for remotely controlling is wireless.

91. The system of claim 90, in which said means for remotely controlling comprises an infrared signal transmitter.

92. The system of claim 65, further comprising an additional switch means, controlled by a corresponding switch actuator.

93. The system of claim 65, further comprising an additional dimmer means, controlled by a corresponding dimmer actuator.

94. A wall-mountable system for controlling electrical power to a load, said system having a faceplate with a centerline and comprising, in combination:

(a) switch means for turning said power on and off, said switch means including a first actuator means constructed and arranged for operating said switch means; and (b) dimmer means for controlling the amount of power provided to said load, said dimmer means including a second actuator means constructed and arranged for operating said dimmer means, said first actuator constructed and arranged for being operated by a user and having a surface area which is substantially larger than the surface area of said second actuator means which is constructed and arranged for being operated by the user, said first actuator means being centrally positioned on said faceplate and said second actuator being located at a distance from said centerline but adjacent to said first actuator means, whereby the switch function is emphasized over the dimmer function to the user.

95. The system of claim 94, said faceplate being constructive and arranged for mounting over said switch means and dimmer means, said faceplate having an opening through which said first and second actuators extend.

96. The system of claim 94, in which said switch means is mechanical.

97. The system of claim 94, in which said switch means comprises an electronic touch switch.

98. The system of claim 94, in which said switch means is an alternate-action switch.

99. The system of claim 94, in which said switch means is a biased pushbutton switch.

100. The system of claim 99, in which said first actuator means is a pushbutton and depressing said pushbutton about 1 mm does not activate said switch.

101. The system of claim 94, in which said dimmer means is a raise-lower dimmer and said second actuator means comprises a rocker device which is split into two portions, and whereby the depression of one portion causes an increase of said power provided to said load and, conversely, the depression of the other portion causes a decrease of said power provided to said load.

102. The system of claim 101, in which said dimmer means comprises a motorized potentiometer control.

103. The system of claim 101, in which said dimmer means comprises an electronic control.

104. The system of claim 103, in which said electronic control includes a remote control joined to said dimmer means by not more than two wires.

105. The system of claim 94, in which said second actuator means is a linear slide.

106. The system of claim 94, in which said second actuator means is a thumbwheel.

107. The system of claim 94, in which said second actuator means is a rotary knob.

108. The system of claim 107, in which said rotary knob is retractable.

109. The system of claim 95, in which said opening is rectangular.

110. The system of claim 107, in which length and width dimensions of said opening are about 25 mm and about 12 mm, respectively.

111. The system of claim 94, further comprising time-delay circuit means for controllably delaying switching of said power on and off.

112. The system of claim 94, further comprising lamp means for indicating whether power to said load is on.

113. The system of claim 112, in which said lamp means is a light-emitting diode.

114. The system of claim 112, in which said lamp means emits a light intensity that is greater when said power is on than when said power is off.

115. The system of claim 112, in which said second actuator means is a linear slide and said lamp means moves with said slide.

116. The system of claim 94, further comprising means for indicating the amount of power being provided to said load.

117. The system of claim 116, in which said indicating means comprises a light-emitting diode.

118. The system of claim 94, further comprising means for remotely controlling said switch means and dimmer means.

119. The system of claim 118, in which said means for remotely controlling is wireless.

120. The system of claim 119, in which said means for remotely controlling comprises an infrared signal transmitter.

121. The system of claim 94, further comprising an additional switch means, controlled by a corresponding switch actuator.

122. The system of claim 94, further comprising an additional dimmer means, controlled by a corresponding dimmer actuator.

123. A wall-mountable system for controlling electrical power to a load comprising, in combination:

(a) switch means for turning said power on and off, said switch means including a first actuator means constructed and arranged for operating said switch means; and (b) dimmer means for controlling the amount of power provided to said load, said dimmer means including a slider or a rocker device which serves as a second actuator means constructed and arranged for operating said dimmer means, said first and second actuator means being located immediately adjacent to each other, said first and second actuators occupying a region which serves as an active control zone for said wall-mountable system, and said first actuator having a substantially larger surface area to be contacted by the user for operating said switch means than the surface area of the second actuator to be contacted by the user or operating said dimmer means, whereby the switch function is emphasized over the dimmer function to the user.

124. The system of claim 123, further comprising a faceplate for mounting over said switch and dimmer means, said faceplate having an opening through which said first and second actuator means extend.

125. The system of claim 123, in which said switch means is mechanical.

126. The system of claim 123, in which said switch means comprises an electronic touch switch.

127. The system of claim 123, in which said switch means is an alternate-action switch.

128. The system of claim 123, in which said switch means is a biased pushbutton switch.

129. The system of claim 128, in which said first actuator means is a pushbutton and depressing said pushbutton about 1 mm does not activate said switch.

130. The system of claim 123, in which said dimmer means is a raise-lower dimmer and said second actuator means comprises a rocker device which is split into two portions, and whereby the depression of one portion causes an increase of said power provided to said load and, conversely, the depression of the other portion causes a decrease of said power provided to said load.

131. The system of claim 130, in which said dimmer means comprises a motorized potentiometer control.

132. The system of claim 130, in which said dimmer means comprises an electronic control.

133. The system of claim 132, in which said electronic control includes a remote control joined to said dimmer means by not more than two wires.

134. The system of claim 123, in which said second actuator means is a linear slide.

135. The system of claim 124, in which said opening is rectangular.

136. The system of claim 135, in which length and width dimensions of said opening are about 25 mm and about 12 mm, respectively.

137. The system of claim 123, further comprising time-delay circuit means for controllably delaying switching of said power on and off.

138. The system of claim 123, further comprising lamp means for indicating whether power to said load is on.

139. The system of claim 138, in which said lamp means is a light-emitting diode.

140. The system of claim 138, in which said lamp means emits a light intensity that is greater when said power is on than when said power is off.

141. The system of claim 138, in which said second actuator means is a linear slide and said lamp means moves with said slide.

142. The system of claim 123, further comprising means for indicating the amount of power being provided to said load.

143. The system of claim 142, in which said indicating means comprises a light-emitting diode.

144. The system of claim 123, further comprising means for remotely controlling said switch means and dimmer means.

145. The system of claim 144, in which said means for remotely controlling is wireless.

146. The system of claim 145, in which said means for remotely controlling comprises an infrared signal transmitter.

147. The system of claim 123, further comprising an additional switch means, controlled by a corresponding switch actuator.

148. The system of claim 129, further comprising an additional dimmer means, controlled by a corresponding dimmer actuator.

149. A wall-mountable system for controlling electrical power to a load comprising, in combination:

(a) switch means for turning said power on and off, said switch means including a first actuator means constructed and arranged for operating said switch means; and (b) dimmer means for controlling the amount of power provided to said load, said dimmer means including a slider, a rocker device or rotary device which serves as a second actuator means constructed and arranged for operating said dimmer means, said second actuator means being located at the perimeter of said first actuator, said first and second actuator means occupying a region which serves as an active control zone for said wall-mountable system, and said first actuator means having a substantially larger surface area to be contacted by the user for operating said switch means than the surface area of the second actuator to be contacted by the user for operating said dimmer means, whereby the switch function is emphasized over the dimmer function to the user.

150. The system of claim 149, further comprising a faceplate for mounting over said switch and dimmer means, said faceplate having an opening through which said first and second actuator means extend.

151. The system of claim 149, in which said switch means is mechanical.

152. The system of claim 149, in which said switch means comprises an electronic touch switch.

153. The system of claim 149, in which said switch means is an alternate-action switch.

154. The system of claim 149, in which said switch means is a biased pushbutton switch.

155. The system of claim 154, in which said first actuator means is a pushbutton and depressing said pushbutton about 1 mm does not activate said switch.

156. The system of claim 149, in which said dimmer means is a raise-lower dimmer and said second actuator means comprises a rocker device which is split into two portions, and whereby the depression of one portion causes an increase of said power provided to said load and, conversely, the depression of the other portion causes a decrease of said power provided to said load.

157. The system of claim 156, in which said dimmer means comprises a motorized potentiometer control.

158. The system of claim 156, in which said dimmer means comprises an electronic control.

159. The system of claim 158, in which said electronic control includes a remote control joined to said dimmer means by not more than two wires.

160. The system of claim 149, in which said second actuator means is a linear slide.

161. The system of claim 149, in which said second actuator means is a thumbwheel.

162. The system of claim 149, in which said second actuator means is a rotary knob.

163. The system of claim 162, in which said rotary knob is retractable.

164. The system of claim 150, in which said opening is rectangular.

165. The system of claim 164, in which length and width dimensions of said opening are about 25 mm and about 12 mm, respectively.

166. The system of claim 149, further comprising time-delay circuit means for controllably delaying switching of said power on and off.

167. The system of claim 149, further comprising lamp means for indicating whether power to said load is on.

168. The system of claim 167, in which said lamp means is a light-emitting diode.

169. The system of claim 167, in which said lamp means emits a light intensity that is greater when said power is on than when said power is off.

170. The system of claim 167, in which said second actuator means is a linear slide and said lamp means moves with said slide.

171. The system of claim 149, further comprising means for indicating the amount of power being provided to said load.

172. The system of claim 171, in which said indicating means comprises a light-emitting diode.

173. The system of claim 149, further comprising means for remotely controlling said switch means and dimmer means.

174. The system of claim 173, in which said means for remotely controlling is wireless.

175. The system of claim 174, in which said means for remotely controlling comprises an infrared signal transmitter.

176. The system of claim 149, further comprising an additional switch means, controlled by a corresponding switch actuator.

177. The system of claim 149, further comprising an additional dimmer means, controlled by a corresponding dimmer actuator.

178. A wall-mountable system for controlling electrical power to a load comprising, in combination:

(a) switch means for turning said power on and off, said switch means including a first actuator means constructed and arranged for operating said switch means; and (b) dimmer means for controlling the amount of power provided to said load, said dimmer means including a slider or rocker device which serves as a second actuator means constructed and arranged for operating said dimmer means, said first actuator means constructed and arranged for being operated by a user and having a control area which is substantially larger than the control area of said second actuator means which is constructed and arranged for being operated by the user, whereby the switch function is emphasized over the dimmer function to the user.

179. The system of claim 178, further comprising a faceplate for mounting over said switch and dimmer means, said faceplate having an opening through which said first and second actuators extend.

180. The system of claim 178, in which said switch means is mechanical.

181. The system of claim 178, in which said switch means comprises an electronic touch switch.

182. The system of claim 178, in which said switch means is an alternate-action switch.

183. The system of claim 178, in which said switch means is a biased pushbutton switch.

184. The system of claim 183, in which said first actuator means is a pushbutton and depressing said pushbutton about 1 mm does not activate said switch.

185. The system of claim 178, in which said dimmer means is a raise-lower dimmer and said second actuator means comprises a rocker device which is split into two portions, and whereby the depression of one portion causes an increase of said power provided to said load and, conversely, the depression of the other portion causes a decrease of said power provided to said load.

186. The system of claim 185, in which said dimmer means comprises a motorized potentiometer control.

187. The system of claim 185, in which said dimmer means comprises an electronic control.

188. The system of claim 187, in which said electronic control includes a remote control joined to said dimmer means by not more than two wires.

189. The system of claim 178, in which said second actuator means is a linear slide.

190. The system of claim 179, in which said opening is rectangular.

191. The system of claim 190, in which length and width dimensions of said opening are about 25 mm and about 12 mm, respectively.

192. The system of claim 178, further comprising time-delay circuit means for controllably delaying switching of said power on and off.

193. The system of claim 178, further comprising lamp means for indicating whether power to said load is on.

194. The system of claim 193, in which said lamp means is a light-emitting diode.

195. The system of claim 193, in which said lamp means emits a light intensity that is greater when said power is on than when said power is off.

196. The system of claim 193, in which said second actuator means is a linear slide and said lamp means moves with said slide.

197. The system of claim 178, further comprising means for indicating the amount of power being provided to said load.

198. The system of claim 197, in which said indicating means comprises a light-emitting diode.

199. The system of claim 178, further comprising means for remotely controlling said switch means and dimmer means.

200. The system of claim 199, in which said means for remotely controlling is wireless.

201. The system of claim 200, in which said means for remotely controlling comprises an infrared signal transmitter.

202. The system of claim 178, further comprising an additional switch means, controlled by a corresponding switch actuator.

203. The system of claim 178, further comprising an additional dimmer means, controlled by a corresponding dimmer actuator.

204. A wallbox-mountable electrical control comprising, in combination, (a) a pushbutton-actuated electrical control device having a first actuator means for operating said pushbutton-actuated electrical control device, (b) means attachable to said wallbox for supporting said device, (c) dimmer means for controlling the amount of power provided to a load, said dimmer means including a second actuator means constructed and arranged for operating said dimmer means, (d) a faceplate for mounting over said support means, said faceplate having an opening, (e) a pushbutton having integral means for resiliently supporting said pushbutton on said support means, said pushbutton being actuatable through said opening in said faceplate, and (f) means for transmitting a force applied to said pushbutton to provide control of said device, wherein said first actuator means has a substantially larger surface area than said second actuator means, whereby the switch function is emphasized over the dimmer function to the user.

205. The control of claim 204, in which said pushbutton-actuated electrical control device comprises a switch.

206. The control of claim 205, in which said pushbutton-actuated electrical control device comprises a touch switch.

207. The control of claim 205, in which said second actuator means is a linear slide type means.

208. The control of claim 207, in which said second actuator means adjoins said pushbutton.

209. The control of claim 204, further comprising an elongated member on said pushbutton for snapping into a corresponding opening in said support means.

210. The control of claim 204, further comprising an indicator lamp between said support means and said pushbutton.

211. The control of claim 210, in which said force transmitting means is a light pipe and extends between said indicator lamp and said pushbutton.

212. A wall-mountable system for controlling electrical power to a load comprising in combination:

(a) switch means for turning said power on and off, said switch means including a first actuator means adapted for operating said switch means, said first actuator means having upper and lower portions for turning said power on and off, respectively, and a central portion housing means for detecting a signal from an external source for also controlling said power in response to said signal; and (b) dimmer means for controlling the amount of power provided to said load, said dimmer means including a second actuator means adapted for operating said dimmer means, said first actuator having a surface area which is substantially larger than the surface area of said second actuator means, said second actuator means being located adjacent a peripheral edge of said first actuator.

213. The system of claim 1 wherein said first actuator means has a surface area at least four times as large as the surface area of said second actuator means.

214. The system of claim 13 wherein said first actuator means has a surface area at least four times as large as the surface area of said second actuator means.

215. The system of claim 36 wherein said first actuator means has a surface area at least four times as large as the surface area of said second actuator means.

216. The system of claim 65 wherein said first actuator means has a surface area at least four times as large as the surface area of said second actuator means.

217. The system of claim 94 wherein said first actuator means has a surface area at least four times as large as the surface area of said second actuator means.

218. The system of claim 123 wherein said first actuator means has a surface area at least four times as large as the surface area of said second actuator means.

219. The system of claim 149 wherein said first actuator means has a surface area at least four times as large as the surface area of said second actuator means.

220. The system of claim 178 wherein said first actuator means has a surface area at least four times as large as the surface area of said second actuator means.

221. The control of claim 204 wherein said first actuator means has a surface area at least four times as large as the surface area of said second actuator means.

* * * * *

US005637930C1

(12) EX PARTE REEXAMINATION CERTIFICATE (5497th)

United States Patent
Rowen et al.

(10) Number: US 5,637,930 C1
(45) Certificate Issued: Sep. 12, 2006

(54) WALL-MOUNTABLE SWITCH AND DIMMER

(75) Inventors: Michael J. Rowen, Center Valley, PA (US); Joel S. Spira, Coopersburg, PA (US); Michael J. D'Aleo, Erwinna, PA (US); Darryl W. Tucker, Royersford, PA (US); Russell J. Jacobs, Center Valley, PA (US); James R. Graybill, Allentown, PA (US)

(73) Assignee: Lutron Electronics Co., Inc., Coopersburg, PA (US)

Reexamination Request:
No. 90/006,594, Apr. 8, 2003
No. 90/007,153, Aug. 3, 2004

Reexamination Certificate for:

| | |
|---|---|
| Patent No.: | **5,637,930** |
| Issued: | **Jun. 10, 1997** |
| Appl. No.: | **08/386,850** |
| Filed: | **Feb. 10, 1995** |

Related U.S. Application Data

(63) Continuation of application No. 07/871,876, filed on Apr. 21, 1992, now abandoned, which is a continuation of application No. 07/225,457, filed on Jul. 28, 1988, now abandoned.

(51) Int. Cl.
*H01H 47/00* (2006.01)

(52) U.S. Cl. ..... 307/112; 307/125
(58) Field of Classification Search ..... 307/112, 307/125
See application file for complete search history.

(56) References Cited

U.S. PATENT DOCUMENTS

| | | | | | |
|---|---|---|---|---|---|
| 3,225,265 | A | | 12/1965 | Krause et al. | 317/138 |
| 3,584,174 | A | * | 6/1971 | Sprando et al. | 200/314 |
| 3,746,923 | A | | 7/1973 | Spira et al. | 315/291 |
| 3,846,604 | A | | 11/1974 | Shallbetter | 200/168 D |
| 3,971,028 | A | | 7/1976 | Funk | 343/225 |
| 4,131,870 | A | | 12/1978 | Hilgendorf et al. | 338/183 |
| RE30,296 | E | | 6/1980 | Kirby et al. | 307/252 B |
| 4,350,903 | A | | 9/1982 | Jimerson et al. | 307/252 B |
| 4,360,721 | A | | 11/1982 | Niinuma | 200/153 J |
| 4,368,406 | A | | 1/1983 | Kruzich et al. | 315/158 |
| D268,564 | S | | 4/1983 | Mack | D8/353 |
| 4,479,170 | A | | 10/1984 | Richardson | 362/95 |
| 4,551,714 | A | * | 11/1985 | Giammarese | 340/825.72 |
| 4,556,863 | A | | 12/1985 | Devitt et al. | 340/81 R |
| 4,563,592 | A | | 1/1986 | Yuhasz et al. | 307/115 |
| 4,567,375 | A | | 1/1986 | Jimerson et al. | 307/98 |
| 4,649,323 | A | | 3/1987 | Pearlman | 315/307 |
| 4,670,629 | A | | 6/1987 | VanBenthuysen et al. | 200/5 C |
| 4,695,820 | A | | 9/1987 | D'Aleo | 338/179 |
| 4,751,355 | A | * | 6/1988 | Wisskirchen et al. | 200/521 |
| 4,764,717 | A | | 8/1988 | Tucker et al. | 323/364 |
| 4,770,518 | A | | 9/1988 | Emmel | 350/523 |
| 4,825,200 | A | * | 4/1989 | Evans et al. | 341/23 |
| 5,017,837 | A | | 5/1991 | Hanna et al. | 315/136 |
| 5,146,153 | A | | 9/1992 | Luchaco et al. | 323/324 |

FOREIGN PATENT DOCUMENTS

| | | |
|---|---|---|
| CH | 500 580 | 1/1971 |
| DE | 35 29 711 C2 | 3/1987 |
| DE | 37 07 951 | 9/1987 |
| FR | 2 116 669 | 7/1972 |
| FR | 2119669 | 7/1972 |

(Continued)

OTHER PUBLICATIONS

Home Automation Catalog, Jan. 1984, p. 7.

(Continued)

*Primary Examiner*—Robert L. DeBeradinis

(57) ABSTRACT

A wall-mountable system for controlling electrical power to a load includes a switch and a dimmer, with the switch actuator being substantially larger than the dimmer actuator. Preferably, the switch is a short-throw, light-force switch and the dimmer is a linear slide dimmer. Another embodiment of the invention provides a wallbox-mountable, pushbutton-actuated electrical control device in which the pushbutton is resiliently supported on the device support.

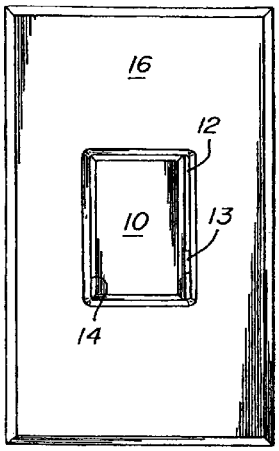

FOREIGN PATENT DOCUMENTS

| | | | |
|---|---|---|---|
| GB | 239 950 | | 9/1925 |
| GB | 1 451 438 | | 10/1976 |
| GB | 2 013 049 | A | 8/1979 |
| GB | DES 1 048 797 | | 9/1980 |
| GB | 1 603 862 | | 12/1981 |
| GB | 2 128 822 | A | 5/1984 |
| JP | 55-159689 | | 12/1980 |
| JP | 56-28199 | | 3/1981 |
| JP | 56-129100 | U | 10/1981 |
| JP | 59-114792 | A | 7/1984 |
| JP | 59-113022 | | 8/1984 |
| JP | 59-219897 | A | 12/1984 |
| JP | 61-243694 | A | 10/1986 |

OTHER PUBLICATIONS

Extract from Matsushita Electric Works, Ltd. Brochure 89/4 (4th Qtr 1989).
Home Automation Catalog, Jan. 1984.
Eagle Catalog, Fall–Winter 1989.
Patent Abstract, Australian Patent Application No. 38914/89, Australian Patent Office, Feb. 1, 1990.

* cited by examiner

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 2, 9, 18, 19, 22, 26, 34, 35, 37, 44, 51, 52, 55, 59, 66, 73, 80, 81, 84, 88, 95, 102, 109, 110, 113, 117, 124–148, 150–177, 179, 186, 190, 191, 194, 198, 206, 208, 218 and 219 are cancelled.

Claims 1, 13, 32, 33, 36, 65, 94, 123, 149, 178, 204 and 212 are determined to be patentable as amended.

Claims 3–8, 10–12, 14–17, 20–21, 23–25, 27–31, 38–43, 45–50, 53–54, 56–58, 60–64, 67–72, 74–79, 82–83, 85–87, 89–93, 96–101, 103–108, 111–112, 114–116, 118–122, 180–185, 187–189, 192–193, 195–197, 199–203, 205, 207, 209–211, 213–217 and 220–221, dependent on an amended claim, are determined to be patentable.

1. A wall-mountable system for controlling electrical power to a load comprising, in combination:

(a) switch means for turning said power on and off, including first pushbutton or touch actuator means constructed and arranged for operating said switch means; [and]

(b) dimmer means for controlling the amount of power provided to said load, including second actuator means constructed and arranged for operating said dimmer means, said first actuator means constructed and arranged for being operated by a user and having a surface area which is substantially larger than the surface area of said second actuator means which is constructed and arranged for being operated by the user[.]; *and*

(*c*) *a faceplate for mounting over said switch means and dimmer means, said faceplate having an opening through which said first and second actuators extend;* said first and second actuator means being located immediately adjacent to each other, said first and second actuator means occupying a region which serves as an active control zone for said wall-mountable system, said active control zone having a surface area which is dominated by the surface area of said first actuator means, whereby the switch function is emphasized over the dimmer function to the user.

13. A wall-mountable system for controlling electrical power to a load comprising, in combination:

(a) switch means for turning said power on and off, including first [pushbutton or touch] actuator means *which is a pushbutton* constructed and arranged for operating said switch means; and (b) dimmer means for controlling the amount of power provided to said load, including second actuator means constructed and arranged for operating said dimmer means[.]; *and*

(*c*) *a faceplate for mounting over said switch means and dimmer means, said faceplate having an opening through which said first and second actuators extend;* said first actuator means being substantially larger than said second actuator means, said second actuator means being a linear slide and in which said [first actuator means is a] pushbutton [and] is located immediately adjacent to said linear slide, whereby the switch function is emphasized over the dimmer function to the user.

32. The [control] *system* of claim 31, *wherein said pushbutton or touch actuator means comprises a pushbutton,* further comprising *support means for supporting said device and* an indicator lamp between said support means and said pushbutton.

33. The [control] *system* of claim 32, *further comprising means for transmitting a force applied to said pushbutton to provide control of said device,* in which said force transmitting means is a light pipe and extends between said indicator lamp and said pushbutton.

36. A wall-mountable system for controlling electrical power to a load comprising, in combination:

(a) switch means for turning said power on and off, said switch means including a first actuator means constructed and arranged for operating said switch means; and (b) dimmer means for controlling the amount of power provided to said load, said dimmer means including a second actuator means constructed and arranged for operating said dimmer means, said first actuator means constructed and arranged for being operated by a user and having a surface area which is substantially larger than the surface area of said second actuator means which is constructed and arranged for being operated by the user*; and*

(*c*) *a faceplate for mounting over said switch means and dimmer means, said faceplate having an opening through which said first and second actuators extend*, said second actuator means being located at the perimeter of said first actuator, whereby the switch function is emphasized over the dimmer function to the user.

65. A wall-mountable system for controlling electrical power to a load, said system having a faceplate with a *vertical* centerline and comprising, in combination:

(a) switch means for turning said power on and off, said switch means including a first actuator means constructed and arranged for operating said switch means; and (b) dimmer means for controlling the amount of power provided to said load, said dimmer means including a second actuator means constructed and arranged for operating said dimmer means, said first actuator means being centrally positioned on said faceplate and said second actuator means being located at a distance from said *vertical* centerline, wherein said first actuator means has a surface area at least two times as large as the surface area of said second actuator means, whereby the switch function is emphasized over the dimmer function to the user*, said faceplate being constructed and arranged for mounting over said switch means and dimmer means, said faceplate having an opening through which said first and second actuator means extend*.

94. A wall-mountable system for controlling electrical power to a load, said system having a faceplate with a centerline and comprising, in combination:

(a) switch means for turning said power on and off, said switch means including a first actuator means constructed and arranged for operating said switch means; and (b) dimmer means for controlling the amount of power provided to said load, said dimmer means including a second actuator means constructed and arranged for operating said dimmer means, said first actuator constructed and arranged for being operated by a user and having a surface area which is substantially larger than the surface area of said second actuator means which is constructed and arranged for being operated by the user, said first actuator means being centrally positioned on said faceplate *and positioned on said centerline* and said second actuator being located at a distance from said centerline but adjacent to said first actuator means, whereby the switch function is emphasized over the dimmer function to the user*, said faceplate being constructed and arranged for mounting over said switch means and dimmer means, said faceplate having an opening through which said first and second actuators extend.*

123. [A wall-mountable] *The* system [for controlling electrical power to a load comprising, in combination:

(a) switch means for turning said power on and off, said switch means including a first actuator means constructed and arranged for operating said switch means; and (b) dimmer means for controlling the amount of power provided to said load, said dimmer means including a slider or a rocker device which serves as a second actuator means constructed and arranged for operating said dimmer means,] *according to claim 178, wherein* said first and second actuator means [being located] *extend through said opening* immediately adjacent to each other[, said first and second actuators occupying a region which serves as an active control zone for said wall-mountable system, and said first actuator having a substantially larger surface area to be contacted by the user for operating said switch means than the surface area of the second actuator to be contacted by the user for operating said dimmer means, whereby the switch function is emphasized over the dimmer function to the user].

149. [A wall-mountable] *The* system [for controlling electrical power to a load comprising, in combination:

(a) switch means for turning said power on and off, said switch means including a first actuator means constructed and arranged for operating said switch means; and (b) dimmer means for controlling the amount of power provided to said load, said dimmer means including a slider, a rocker device or rotary device which serves as a second actuator means constructed and arranged for operating said dimmer means,] *according to claim 178, wherein* said second actuator means [being] *is* located at the perimeter of said first actuator *means*, *and* said first and second actuator means [occupying] *occupy* a region which serves as an active control zone for said wall-mountable system[, and said first actuator means having a substantially larger surface are to be contacted by the user for operating said switch means than the surface area of the second actuator to be contacted by the user for operating said dimmer means, whereby the switch function is emphasized over the dimmer function to the user].

178. A wall-mountable system for controlling electrical power to a load comprising, in combination:

(a) switch means for turning said power on and off, said switch means including a first actuator means constructed and arranged for operating said switch means; [and]

(b) dimmer means for controlling the amount of power provided to said load, said dimmer means including a slider or rocker device which serves as a second actuator means constructed and arranged for operating said dimmer means, said first actuator means constructed and arranged for being operated by a user and having a control area which is substantially larger than the control area of said second actuator means which is constructed and arranged for being operated by the user, whereby the switch function is emphasized over the dimmer function to the user*; and*

(*c*) *a faceplate for mounting over said switch and dimmer means, said faceplate having an opening through which said first and second actuators extend and said second actuator means being located adjacent a peripheral edge of said first actuator means within said opening.*

204. A wallbox-mountable electrical control comprising, in combination, (a) a pushbutton-actuated electrical control device having a first actuator means for operating said pushbutton-actuated electrical control device, (b) means attachable to said wallbox for supporting said device, (c) dimmer means for controlling the amount of power provided to a load, said dimmer means including a second actuator means constructed and arranged for operating said dimmer means, (d) a faceplate for mounting over said support means, said faceplate having an opening, (e) *said first actuator means comprising* a pushbutton having integral means for resiliently supporting said pushbutton on said support means, said pushbutton being actuatable through said opening in said faceplate, and (f) means for transmitting a force applied to said pushbutton to provide control of said device, *wherein said second actuator means is actuatable through said opening in said faceplate and adjoins said pushbutton, and* wherein said first actuator means has a substantially larger surface area than said second actuator means, whereby the switch function is emphasized over the dimmer function to the user.

212. A wall-mountable system for controlling electrical power to a load comprising in combination:

(a) switch means for turning said power on and off, said switch means including a first actuator means adapted for operating said switch means, said first actuator means having upper and lower portions for turning said power on and off, respectively, and a central portion housing means for detecting a signal from an external source for also controlling said power in response to said signal; and (b) dimmer means for controlling the amount of power provided to said load, said dimmer means including a second actuator means adapted for operating said dimmer means, said first actuator having a surface area which is substantially larger than the surface area of said second actuator means, said second actuator means being located adjacent a peripheral edge of said first actuator*; and*

(*c*) *a faceplate for mounting over said switch and dimmer means, said faceplate having an opening through which said first and second actuators extend and said second actuator means being located adjacent a peripheral edge of said first actuator means within said opening.*

* * * * *

US005637930C2

(12) EX PARTE REEXAMINATION CERTIFICATE (9228th)

United States Patent

Rowen et al.

(10) Number: US 5,637,930 C2

(45) Certificate Issued: Aug. 21, 2012

(54) WALL-MOUNTABLE SWITCH & DIMMER

(75) Inventors: Michael J. Rowen, Center Valley, PA (US); Joel S. Spira, Coopersburg, PA (US); Michael J. D'Aleo, Erwinna, PA (US); Darryl W. Tucker, Royersford, PA (US); Russell J. Jacobs, Center Valley, PA (US); James R. Graybill, Allentown, PA (US)

(73) Assignee: Lutron Electronics Co., Inc., Coopersburg, PA (US)

Reexamination Request:
No. 90/009,936, Aug. 10, 2011

Reexamination Certificate for:

| | |
|---|---|
| Patent No.: | **5,637,930** |
| Issued: | **Jun. 10, 1997** |
| Appl. No.: | **08/386,850** |
| Filed: | **Feb. 10, 1995** |

Reexamination Certificate C1 5,637,930 issued Sep. 12, 2006

Related U.S. Application Data

(63) Continuation of application No. 07/871,876, filed on Apr. 21, 1992, now abandoned, which is a continuation of application No. 07/225,457, filed on Jul. 28, 1988, now abandoned.

(51) Int. Cl.

| | |
|---|---|
| ***H01H 13/02*** | (2006.01) |
| ***H01H 13/14*** | (2006.01) |
| ***H01H 3/02*** | (2006.01) |
| ***H05B 39/00*** | (2006.01) |
| ***H05B 37/02*** | (2006.01) |

(52) U.S. Cl. ..... 307/112; 307/125

(58) Field of Classification Search ..... None
See application file for complete search history.

(56) References Cited

To view the complete listing of prior art documents cited during the proceeding for Reexamination Control Number 90/009,936, please refer to the USPTO's public Patent Application Information Retrieval (PAIR) system under the Display References tab.

*Primary Examiner*—Pia Tibbits

(57) ABSTRACT

A wall-mountable system for controlling electrical power to a load includes a switch and a dimmer, with the switch actuator being substantially larger than the dimmer actuator. Preferably, the switch is a short-throw, light-force switch and the dimmer is a linear slide dimmer. Another embodiment of the invention provides a wallbox-mountable, pushbutton-actuated electrical control device in which the pushbutton is resiliently supported on the device support.

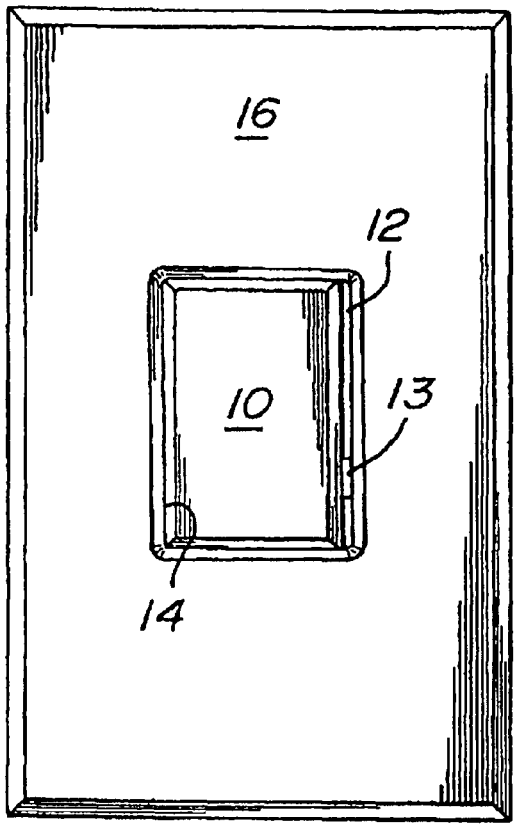

EX PARTE REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1, 3-8, 10-17, 20, 21, 23-25, 27-33, 36, 38-43, 45-50, 53, 54, 56-58, 60-65, 67-72, 74-79, 82, 83, 85-87, 89-94, 96-101, 103-108, 111, 112, 114-116, 118-123, 149, 178, 180-185, 187-189, 192, 193, 195-197, 199-205, 207, 209-217, 220 and 221 is confirmed.

Claims 2, 9, 18, 19, 22, 26, 34, 35, 37, 44, 51, 52, 55, 59, 66, 73, 80, 81, 84, 88, 95, 102, 109, 110, 113, 117, 124-148, 150-177, 179, 186, 190, 191, 194, 198, 206, 208, 218 and 219 were previously cancelled.

* * * * *